US005197615A

United States Patent [19]

Gunnarson

[11] Patent Number: 5,197,615

[45] Date of Patent: Mar. 30, 1993

[54] CRANE

[75] Inventor: Wiking Gunnarson, Dals Långed, Sweden

[73] Assignee: Mo-Trac Gunnarson & Larsson Handelsbolag, Dals Langed, Sweden

[21] Appl. No.: 736,231

[22] PCT Filed: May 7, 1990

[86] PCT No.: PCT/SE90/00294

§ 371 Date: Nov. 13, 1991

§ 102(e) Date: Nov. 13, 1991

[87] PCT Pub. No.: WO90/14302

PCT Pub. Date: Nov. 29, 1990

[30] Foreign Application Priority Data

May 16, 1989 [SE] Sweden ..... 8901734

[51] Int. Cl.[5] ..... B66C 23/34

[52] U.S. Cl. ..... 212/185; 212/188; 212/261

[58] Field of Search ..... 212/183, 185, 186, 187, 212/188, 261, 238, 182

[56] References Cited

U.S. PATENT DOCUMENTS

| | | | |
|---|---|---|---|
| 2,500,815 | 3/1950 | Gerli et al. | 212/187 |
| 3,775,798 | 12/1973 | Thorton-Trump | 212/185 |
| 4,150,754 | 4/1979 | Schmitt | 212/188 |
| 4,583,906 | 4/1986 | Frisbee | 212/185 |
| 4,895,263 | 1/1990 | Saint Gerand | 212/187 |
| 5,016,767 | 5/1991 | Thibault | 212/187 |

*Primary Examiner*—Jesus D. Sotelo
*Assistant Examiner*—Stephen P. Avila
*Attorney, Agent, or Firm*—Kirkpatrick & Lockhart

[57] ABSTRACT

A crane comprising a rigid column pivotally mounted on a support structure, an arm section connected to the column and comprising two arm portions which extend substantially parallel with one another, a maneuvering device which acts between the arm portions, a rocker arm which is mounted for pivotal movement in one plane on the end of the arm section distal from the column and the free end of which rocker arm is intended to carry a lifting device, tool or the like, wherein the other ends of the mutually parallel arm portions are mutually spaced apart and are connected with a yoke for pivotal movement in the aforementioned plane. The invention is characterized by a carrier arm which is connected at one end thereof to the column for pivotal movement in the aforementioned plane and the other end of which carrier arm is connected to the arm section for pivotal movement in the aforementioned plane by a journal shaft separated from the journal shafts of the parallel arm portions on the yoke. A first piston-cylinder maneuvering device is mounted between the column and the yoke and a second piston-cylinder device maneuvering device is mounted between the column and the carrier arm.

5 Claims, 4 Drawing Sheets

CRANE

BACKGROUND OF THE INVENTION

The present invention relates to a crane in accordance with the preamble of claim 1.

FIELD OF THE INVENTION

The crane is intended for lifting goods, i.e. functions as a lifting crane, and/or as a carrier for working implements, such as tree-felling saws, branching and barking tools, feeders etc. The crane can be mounted on a fixed station or mounted on a vehicle.

A crane of this kind is known from Swedish Patent Specification No. 7411568-4. The present invention is a further development of this known crane, and is intended to provide a crane in which during a working operation, the moment of force will be substantially constant throughout the whole of the normal working range of the crane, and also to provide a crane which can be brought to a compact transport state.

This can be achieved with a crane having the characteristic features set forth in the following claims.

BRIEF DESCRIPTION OF THE DRAWINGS

The invention will now be described in more detail with reference to two exemplifying embodiments thereof and with reference to the accompanying drawings, in which.

DETAILED DESCRIPTION OF THE PREFERRED EMBODIMENT

Figure 1:
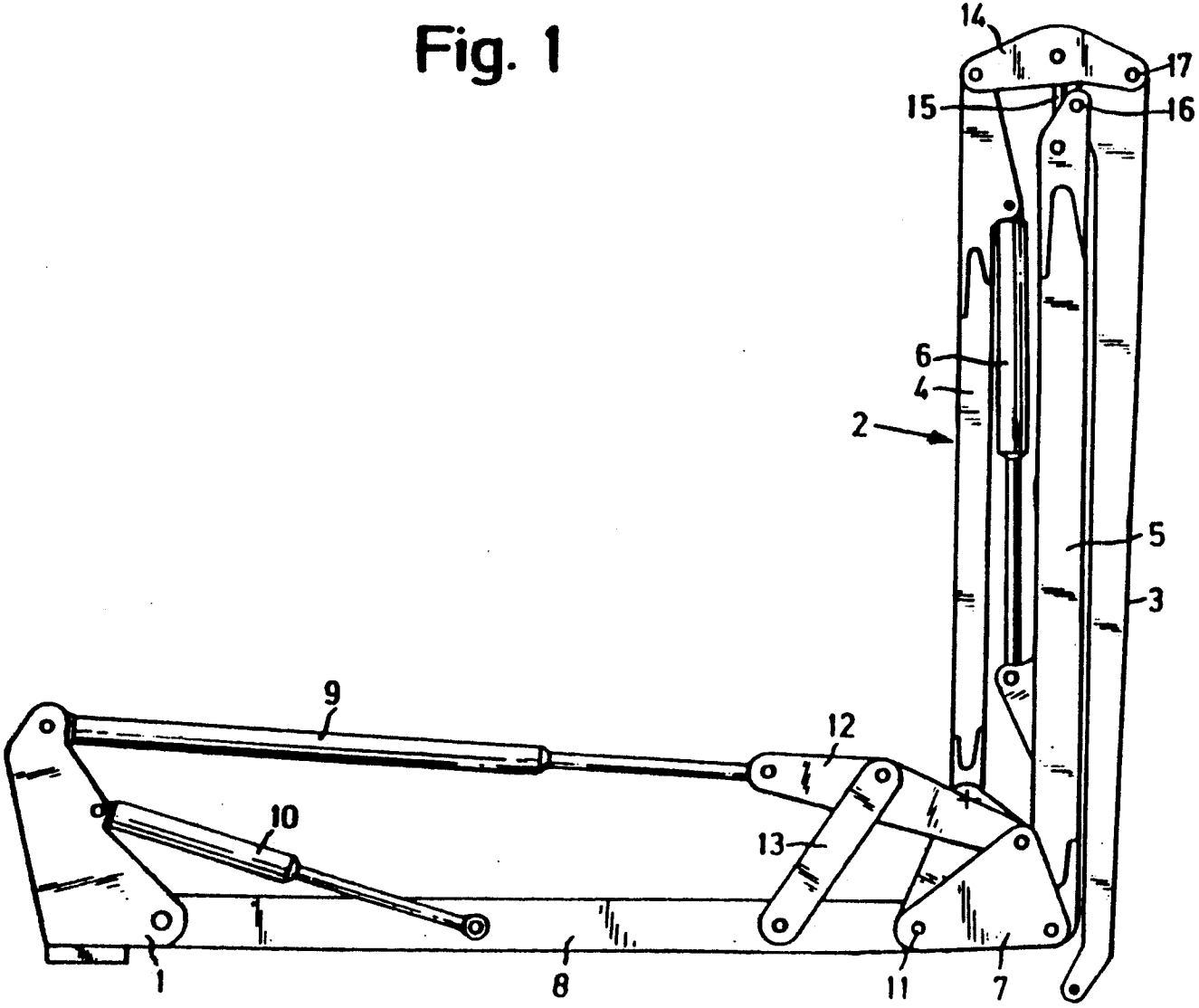
FIGS. 1 and 2 illustrate one embodiment of the inventive crane.

The illustrated crane comprises, in principle, a column 1 which is rotatably mounted on a foundation structure (not shown) which may be either stationarily positioned or located on some kind of vehicle. The column 1 carries an arm section 2 which is pivotal in the vertical plane and which, in the same plane, pivotally carries a rocker arm 3, the free end of which is intended to carry a load. The arm section 2 comprises two arms 4 and 5 which extend substantially parallel with one another and between which a manoeuvering device 6 is mounted, said device having the form of one or two hydraulic piston-cylinder devices. The mutually parallel arms 4 and 5 are pivotally connected to a common arm or yoke 7.

According to the invention, the arm section 2 is carried by a carrier arm 8 which is pivotally journalled to the column 1. Arranged between the column 1 and the yoke 7 is a first manoeuvering piston-cylinder device 9, which is operated hydraulically. A second, hydraulically-operated manoeuvering piston-cylinder device 10 is mounted between the column 1 and the carrier arm 8.

Figure 2:
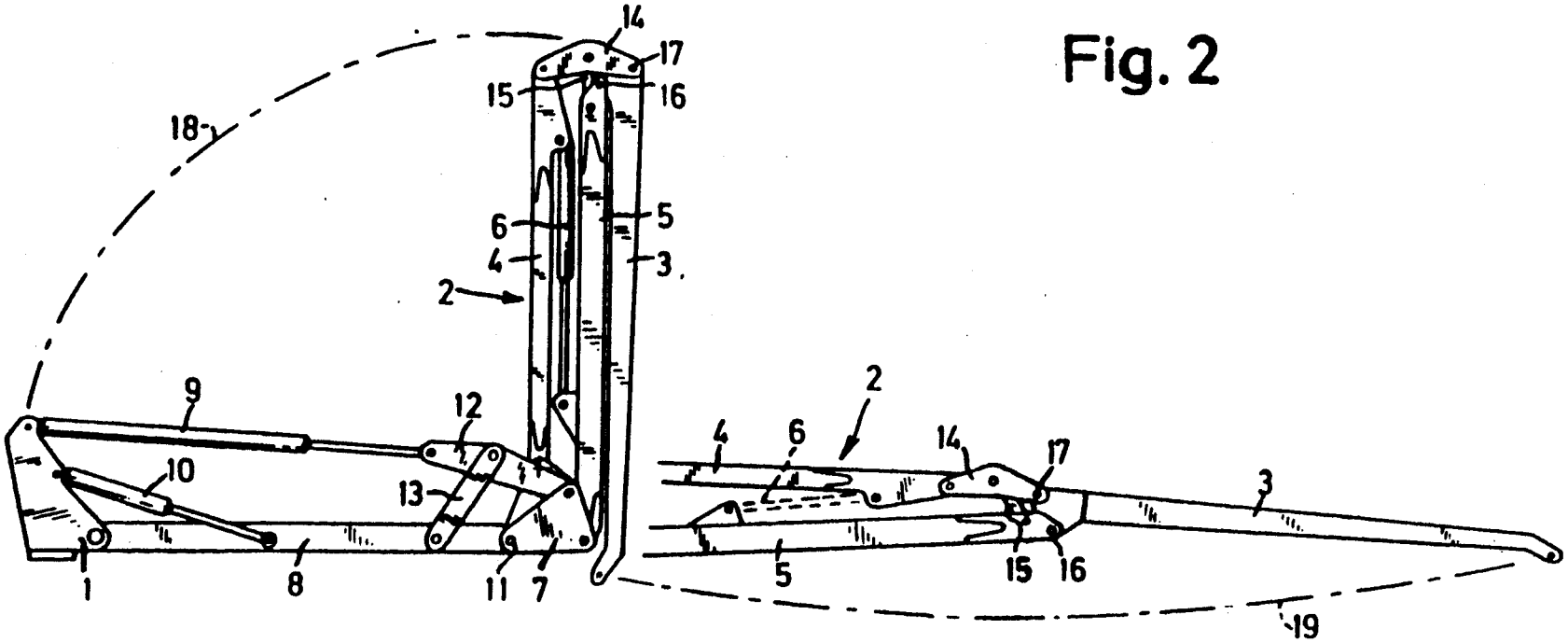

In the embodiment illustrated in FIGS. 1 and 2, the arm section 2 is carried by the carrier arm 8 through the intermediary of a journal shaft 11 provided on the yoke 7. In the case of this embodiment, the first piston-cylinder device 9 is pivotally connected to the yoke 7 via a first link arm 12. This first link arm has pivotally mounted between its respective journal points on the yoke and manoeuvering piston-cylinder device a second link-arm 13 which is pivotally connected to the carrier arm 8.

The ends of the arms 4 and 5 of said arm section 2 distal from the yoke 7 are connected together by means of a rocker-arm yoke 14 in the manner illustrated in the Figures, so that the arm 4 is directly pivotally connected to the rocker-arm yoke and the arm 5 is pivotally connected to the rocker-arm yoke 14 via a link-arm 15 which is connected to the yoke approximately centrally thereon. The arm 5 is also pivotally connected to the rocker arm 3 in a bearing 16, this rocker arm 3 also being connected, through a bearing 17, to the end of the rocker-arm yoke 14 distal from the arm 4.

FIG. 2 illustrates the positional state of the arm section 2 with rocker arm 3 in an upstanding position relative to the carrier arm 8 with the yoke 7, this upstanding position being governed by the manoeuvering piston-cylinder device 9. In the illustrated case, the manoeuvering piston-cylinder device 9 is duplicated, as are also the link arms 12 and 13, in a manner such as to enable the arm section 2 with rocker arm 3 to be collapsed over the carrier arm 8, as illustrated by the broken line 18. FIG. 2 also illustrates schematically a positional state in which the arm section 2 is collapsed substantially in line with the carrier arm 8 and with the rocker arm 3 also extended substantially along this line. The yoke 7 has not been rotated. In order to achieve this position, the free, load-carrying end of the rocker arm 3 moves or sweeps in the movement path shown by the broken line 19. This movement is achieved by activation of the manoeuvering piston-cylinder device 6.

Figure 3:
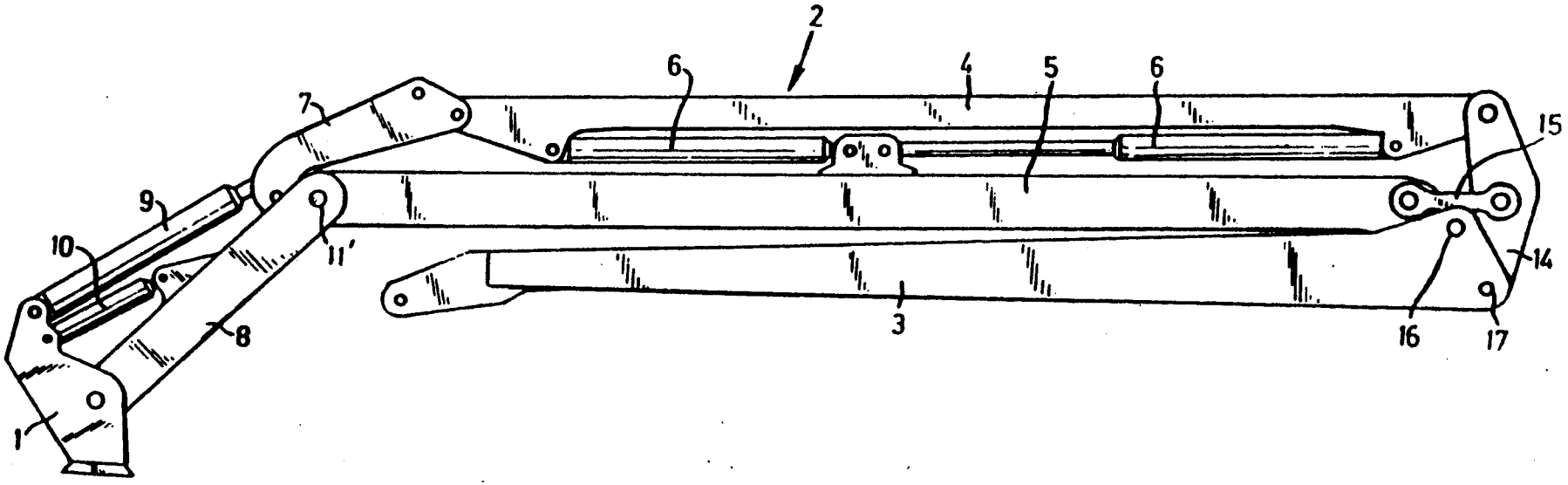
FIGS. 3 and 4 illustrate another embodiment of the invention.
Figure 4:
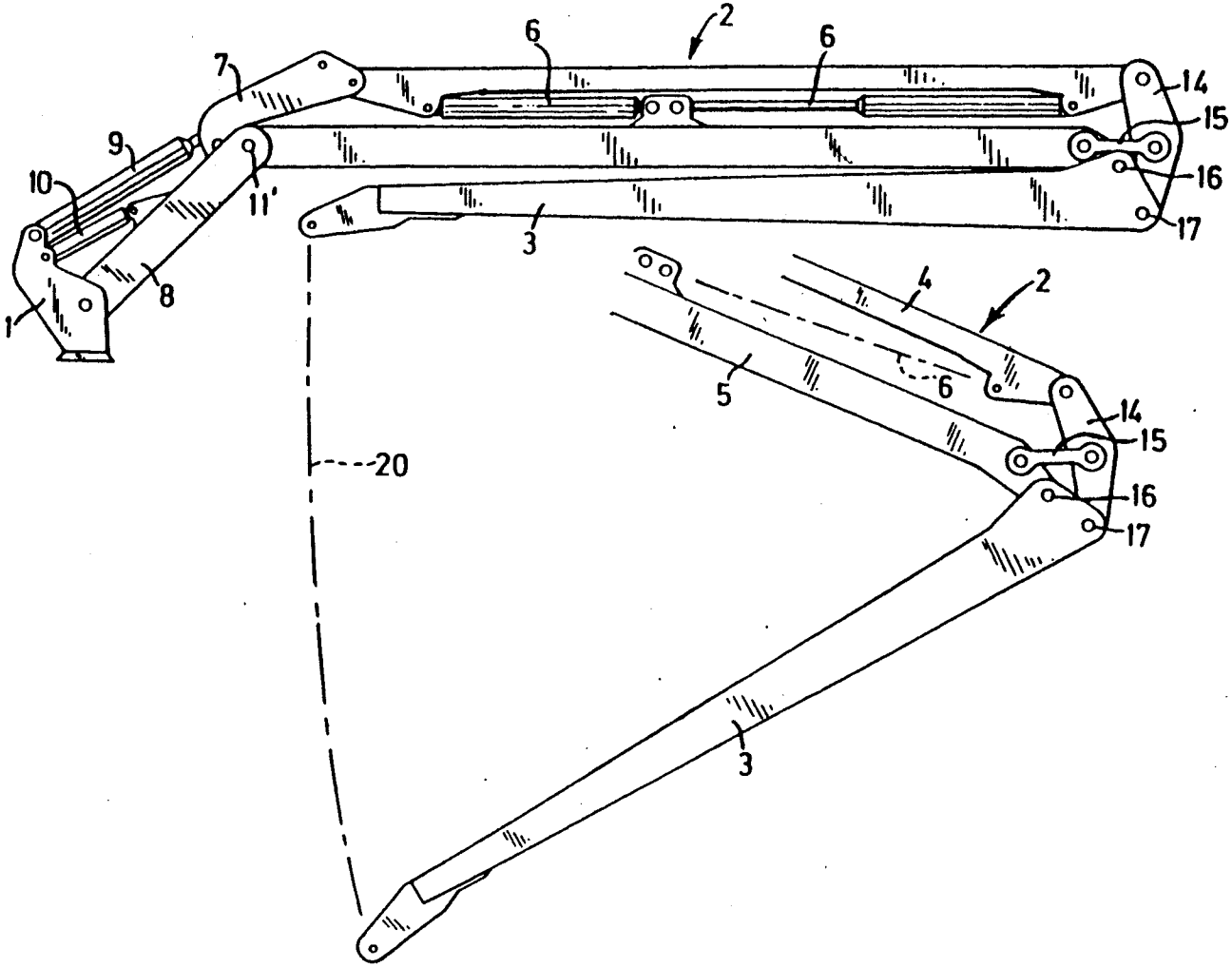

In the case of the crane embodiment illustrated in FIGS. 3 and 4, the arm section 2 is journalled on the carrier arm 8 by means of a journal shaft 11', which is located on the arm 5 at some distance from the journal of yoke 7 on said arm. The connection of the rocker arm 3 to the arm section 2 corresponds to that previously described with reference to FIGS. 1 and 2. FIG. 4 illustrates the arm section 2 extended substantially horizontally from the yoke 7 and with the rocker-arm 3 collapsed substantially parallel with said section 2. The Figure also shows the arm section 2 swung downwards with the aid of the manoeuvering piston-cylinder device 6, while maintaining the position of the yoke 7, the free end of the rocker arm 3 thus moving along the path illustrated by the broken line 20.

The manoeuvering device 6, which may the form of one or more hydraulic piston-cylinder devices functions to move the free end of the rocker-arm 3, and therewith the load carried thereon, in a substantially linear sweeping movement 19 and 20 respectively at a uniform speed and in a uniform force-moment curve, this latter being achieved through the yoke 7 and through the rocker-arm yoke 14 with the link arm 15, such that the arms 4 and 5 of the arm section 2 will be spaced some considerable distance apart during normal, load-carrying movements. This will avoid overloading the arms and piston-cylinder manoeuvering devices. The first piston-cylinder manoeuvering device 9—hydraulic piston-cylinder device or devices—is operative to control the inclination of said movement path of the free-end or tip of the rocker arm 3, whereas the second piston-cylinder manoeuvering device 10—hydraulic piston-cylinder device or devices—is operative to control the vertical position of the arm section 2 in relation to the column 1, without changing its angle of inclination to any appreciable extent.

The load-bearing end of the rocker arm 3 can be made to work within wide limits with moderate loading of arms and manoeuvering devices, by mutual coaction between the piston-cylinder manoeuvering devices 6, 9 and 10, either simultaneously or in sequence, and it is also possible with the crane illustrated in FIGS. 1 and 2 to move the arm section 2 through an angle of 225° in relation to the carrier arm 8, whereas this movement in the case of the embodiment illustrated in FIGS. 3 and 4 is about 130°.

I claim:

1. A crane comprising:

a rigid column pivotally mounted on a support structure, an arm section connected to said column and comprising first and second arm portions which extend substantially parallel with one another, said first and second arm portions each having first ends distal from said column and second ends, a manoeuvering device which acts between said first and second arm portions, a rocker arm which is mounted for pivotal movement in one plane on the distal end of each of said first and second arm portions, said rocker arm having a free end intended to carry a lifting device, wherein the second ends of the mutually parallel first and second arm portions are mutually spaced apart and are connected by means of journal shafts with a yoke for pivotal movement in said plane;

a carrier arm having two ends, one end of said carrier arm is connected to the column for pivotal movement in said plane and the other end of said carrier arm is connected to the arm section for pivotal movement in said plane by means of a second journal shaft separate from the journal shafts of the parallel first and second arm portions on the yoke;

a first piston cylinder manoeuvering device mounted between the column and the yoke; and a second piston-cylinder manoeuvering device mounted between the column and the carrier arm.

2. A crane according to claim 1, characterized in that said second journal shaft of said carrier arm is located in said second arm portion.

3. A crane according to claim 1, characterized in that the journal shaft of the carrier arm is located in the yoke.

4. A crane according to claim 3, characterized in that the first piston-cylinder manoeuvering device is pivotally connected to the yoke via a first link arm which is pivotally connected to one end of a second link arm between the respective pivot points of the manoeuvering device and the yoke, said second link arm, in turn, being pivotally connected at its other end to said carrier arm.

5. A crane according to claim 1, characterized in that the rocker arm is pivotally connected by two mutually separate journal shafts with said second arm portion of the arm section and with a rocker-arm yoke respectively, said rocker arm yoke being journalled to the first arm portion of said arm section and to the said second arm portion of said arm section via a link-arm.

* * * * *

UNITED STATES PATENT AND TRADEMARK OFFICE

CERTIFICATE OF CORRECTION

PATENT NO. : 5,197,615

DATED : March 30, 1993

INVENTOR(S) : Wiking Gunnarson

It is certified that error appears in the above-indentified patent and that said Letters Patent is hereby corrected as shown below:

Titie Page,
Item [21] delete

"Appln. No.: 736,231" and substitute therefore --Appln. No.: 773,623--.

Signed and Sealed this

Fourth Day of January, 1994

*Attest:*

*Attesting Officer*

BRUCE LEHMAN

*Commissioner of Patents and Trademarks*